US005601284A

United States Patent [19]

Blackwell et al.

[11] Patent Number: 5,601,284

[45] Date of Patent: Feb. 11, 1997

[54] ADJUSTABLE BASKETBALL GOAL

[76] Inventors: Scott Blackwell, 1322 Wallace Rd. NW. #38, Salem, Oreg. 97304; James Cahill, 157 Cherry St., Dallas, Oreg. 97338

[21] Appl. No.: 600,265

[22] Filed: Feb. 12, 1996

[51] Int. Cl.[6] ..... A63B 63/08

[52] U.S. Cl. ..... 473/483; 248/404; 254/93 R

[58] Field of Search ..... 273/1.5 R, 1.5 A; 248/404, 161, 654; 254/93; 187/272–275, 413

[56] References Cited

U.S. PATENT DOCUMENTS

| | | | |
|---|---|---|---|
| 254,741 | 3/1882 | Walsh | 254/93 H |
| 895,008 | 8/1908 | German | 187/272 X |
| 2,227,310 | 12/1940 | Hoppes et al. | 273/1.5 R |
| 2,854,061 | 9/1958 | Romito | 248/404 |
| 3,137,502 | 6/1964 | Duganich | 273/1.5 R |
| 3,146,592 | 9/1964 | Johnson | 248/404 X |
| 3,427,025 | 2/1969 | Procter | 273/1.5 |
| 3,586,324 | 6/1971 | Bearson | 273/1.5 R |
| 3,602,504 | 8/1971 | Chapman et al. | 273/1.5 R |
| 3,650,530 | 3/1972 | Gantz | 272/78 |
| 3,669,450 | 6/1972 | Mason | 273/1.5 R |
| 3,765,676 | 10/1973 | Bearson | 273/1.5 R |
| 3,881,724 | 5/1975 | Beveridge | 273/1.5 R |
| 4,101,005 | 7/1978 | Fewkes | 248/404 X |
| 4,218,058 | 8/1980 | Hilbert et al. | 273/1.5 R |
| 4,234,989 | 11/1980 | Pearcy | 248/404 X |
| 4,395,040 | 7/1983 | White | 273/1.5 R |
| 4,412,679 | 11/1983 | Mahoney et al. | 248/404 X |
| 4,846,470 | 7/1989 | Peterson | 273/1.5 R |
| 4,881,734 | 11/1989 | Nye | 273/1.5 R |
| 4,941,661 | 7/1990 | Lykens | 273/1.5 R |
| 4,948,127 | 8/1990 | Willard | 273/1.5 R |
| 4,951,944 | 8/1990 | Morgan | 273/1.5 |
| 4,974,841 | 12/1990 | Jarriel et al. | 273/1.5 R |
| 5,037,093 | 8/1991 | Roark, Jr. | 273/1.5 R |
| 5,102,127 | 4/1992 | Pohrer | 273/1.5 R |
| 5,156,395 | 10/1992 | Smith | 273/1.5 R |
| 5,211,393 | 5/1993 | Rolffs et al. | 273/1.5 R |
| 5,259,612 | 11/1993 | Matherne et al. | 273/1.5 R |
| 5,324,027 | 6/1994 | Nye | 273/1.5 R |

*Primary Examiner*—Paul E. Shapiro
*Attorney, Agent, or Firm*—Walter A. Hackler

[57] ABSTRACT

An adjustable basketball goal generally includes a movable support, telescoped within a vertically mounted fixed support, and a hydraulic, water-powered drive mechanism for enabling the raising or lowering of a basketball rim connected to the upper end of the movable support. The drive mechanism includes a dual-compartment water piston and is powered by a conventional garden hose using ordinary household water pressure. With appropriate adjustments made to the water piston, the drive mechanism may be alternatively operable by pneumatic pressure as well as hydraulic pressure. A valve is included for enabling manual control of the drive mechanism. The adjustable basketball goal may also include a rotatable coupling between the movable and fixed supports such that the basketball rim may be rotated 360 degrees about an axis defined by the vertically mounted supports.

21 Claims, 2 Drawing Sheets

FIG. 2.
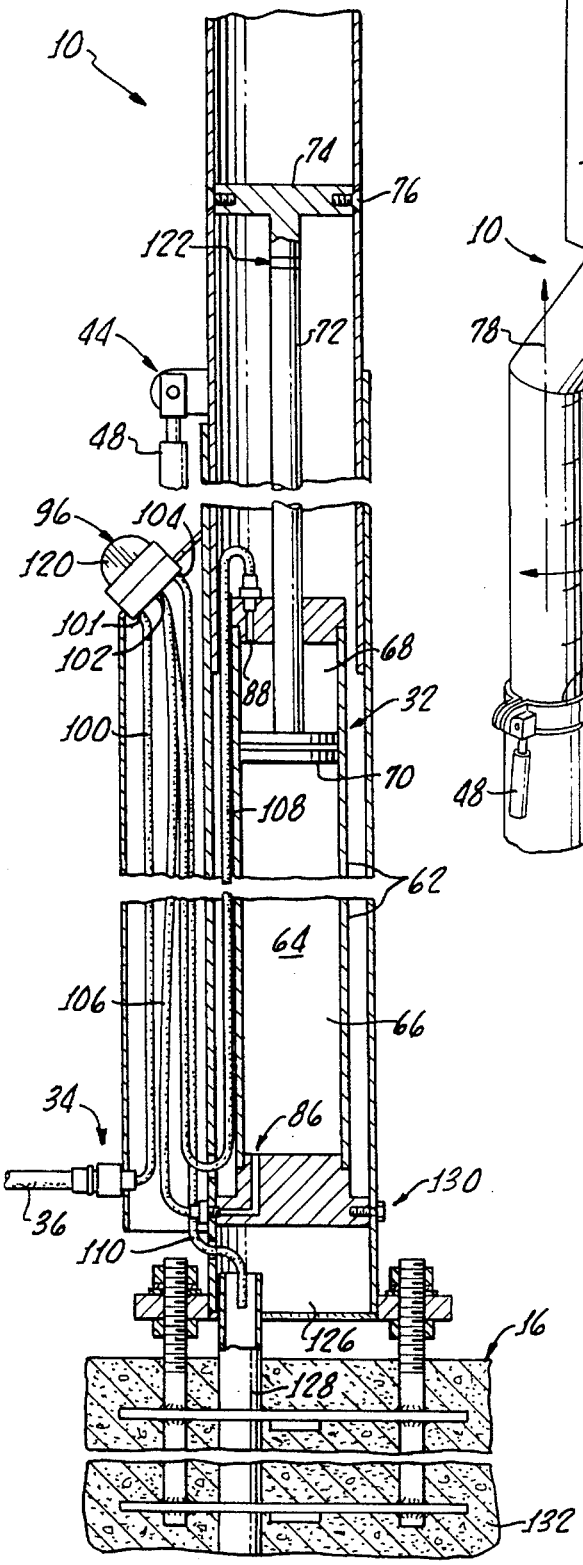
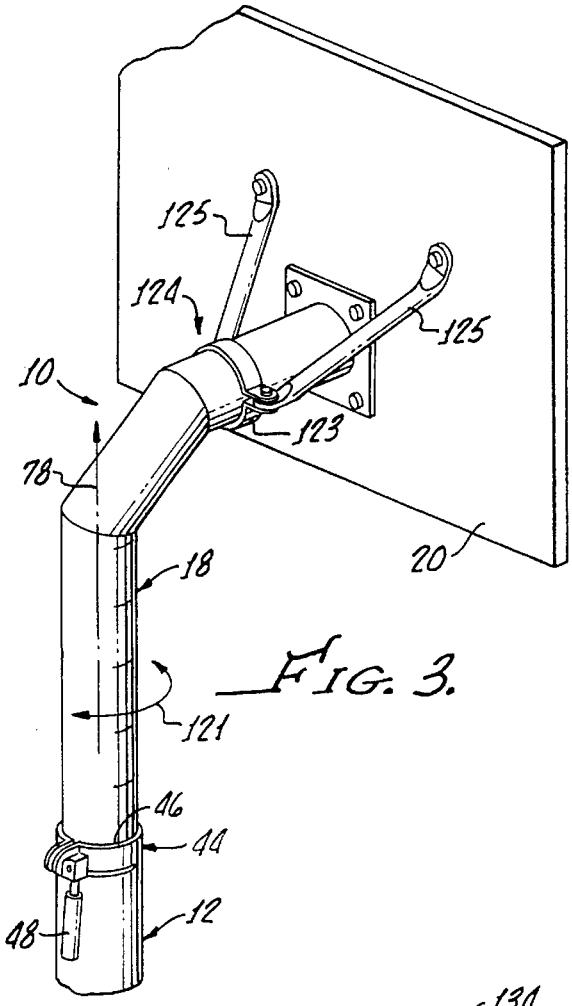
FIG. 3.
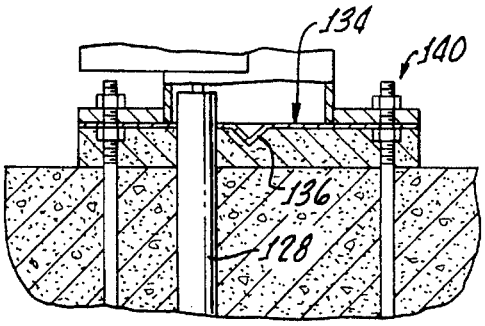
FIG. 7.
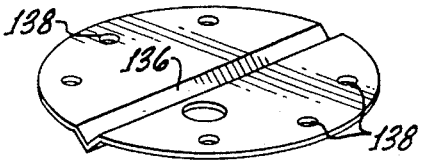
FIG. 8.

ADJUSTABLE BASKETBALL GOAL

The present invention generally relates to basketball goals and more particularly relates to a height adjustable, rotatable basketball goal that is hydraulically powered by a conventional garden hose.

Basketball hoops, or rims, are mounted at a standard of ten feet above the ground. Thus, not only does the sport of competitive basketball require players with at least some degree of speed, endurance, and coordination, it also requires players having sufficient height or jumping ability to be able to toss a basketball through a rim located a significant distance above the ground.

Many people, not just the tall and skillful, enjoy playing the sport of basketball. Basketball backboards and rims are commonly mounted at non-standard heights, for use by younger players or those of small stature. Because basketball appeals to people of all ages and sizes, basketball rims are commonly mounted to the outside of houses, above a garage door for instance, in order to enable family members and neighbors to enjoy playing basketball in a driveway or on a patio.

Some families go a step further and dedicate a court-sized patio area adjacent the home, or utilize an adjacent street area, for the sport. This may include mounting a basketball goal, including a vertical stand, into the ground along the patio or street perimeter. Mounting the basketball goal into the ground, by means of a separate vertical stand for the backboard and rim, rather than mounting the backboard and rim directly to a house or other structure, minimizes the risk that a basketball will brake a window or cause damage to roofing tiles. In addition, a concrete patio or street may more closely parallel a standard court than a sloped driveway.

Obviously, a ground mounted basketball goal requires a sufficiently sized patio or yard area and is typically a more expensive and more permanent option than a structure mounted backboard and rim. For these reasons, a family interested in installing a complete, ground mounted basketball goal, usually will install a standard height goal, even though the standard height is usually too high for children to reach. This is done in anticipation that younger family members will grow taller and become more skillful, and thus "grow into" the standard height goal. As hereinbefore noted, a standard height goal of about ten feet above the ground is difficult or impossible for many children to reach, thus precluding some family members and neighbors from utilizing the goal. This is unfortunate, because the fundamental ability to toss a ball through a raised hoop may be practiced by very small children, even those as young as three years old, if the rim is not positioned too high.

There is a need for an easily adjustable height basketball goal for home use. Though many attempts have been made to provide a height adjustable basketball goal, none have been heretofore developed that are ideal for home use. Prior art adjustable basketball goals are cumbersome to operate, typically comprising complicated structures utilizing pulleys, ropes, gears and cranks. Many height adjustable goals must be manually adjusted, which requires sufficient strength for lifting a backboard and support structure directly or by means of pulleys. Because of the strength required to lift and maneuver the backboard and rim, children can not adjust them. On the other hand, power operated adjustable basketball goals require electrical wiring and hookups which makes them less than ideal for outdoor home use, and of course tend to be expensive to purchase and install.

Not surprisingly, the makers of conventional adjustable basketball goals have found their primary market to be indoor gymnasiums, for example at schools and major heath and sports facilities, but have not been successful at marketing to and satisfying the needs of consumers such as homeowners and families.

The present invention provides an inexpensive, adjustable basketball goal that is ideal for home use and overcomes the inadequacies of conventional height adjustable goals. Furthermore, the present invention may be operated safely by both children and adults.

SUMMARY OF THE INVENTION

An adjustable basketball goal in accordance with the present invention generally comprises a vertically mounted fixed support, a movable support telescoped within said fixed support, and a basketball backboard and rim mounted at an upper end of the movable support. Importantly, a hydraulic drive mechanism, including a water piston powered by ordinary household water pressure, provides means for forcing the movable support both upwardly and downwardly within the fixed support in order to enable a person to selectively adjust the height of the basketball rim above a ground playing surface.

Particularly, the water piston is mounted in an operative relationship between the fixed and movable supports. The drive mechanism further includes a manually operative valve for providing fluid communication between the water piston and a conventional garden hose. The valve is designed to enable a person to selectively direct water pressure into either a first compartment or a second compartment of the water piston, thus causing the piston to raise or lower the movable support to a desired height. The valve may also include a water outlet for expelling excess water from either compartment of the piston to relieve water pressure therein. Notably, the lowering of the movable support can be done smoothly and safely. The movable support, which may be a relatively heavy component of the device, may be lowered at a slow, easily controllable pace due to the cushioning effect of the water disposed within the piston.

Another feature of the present invention is means for enabling switching of the drive mechanism between hydraulic and pneumatic operation. Thus, with proper adjustments made thereto, the piston may be driven by either a conventional garden hose or a conventional pneumatic pump, for example, a manually operable tire pump.

In order to prevent accumulation of water on the ground surface below the drive mechanism, a drain line or drain plate may be provided.

In addition, the basketball goal in accordance with the present invention may include means for rotatably mounting the movable support with respect to the fixed support such that the basketball rim may be rotated 360 degrees about an axis defined by the supports. Advantageously, this allows a user of the goal to change the position of the backboard and rim when so desired. For example, the backboard and rim may be positioned in a east facing position during morning play and manually rotated to a west facing position during evening play, in order to avoid direct sunlight in a player's eyes.

A separate clamp may be included in order to provide means for securing the movable support at the selected height and rotational position. Yet another feature of the present invention is a slidable sleeve for enabling fine adjustment of an angle of the backboard.

The basketball goal may be permanently mounted to the ground playing surface by any suitable means, such as an underground anchored base, or the like. Alternatively, the basketball goal may be a portable unit.

BRIEF DESCRIPTION OF THE DRAWINGS

These and other features and advantages of the present invention may be more clearly understood with reference to the following detailed description, when considered in conjunction with the accompanying drawings in which:

FIG. 2 shows a cross-sectional view of the hydraulic drive mechanism including a piston and means for providing fluid communication between said piston and a conventional garden hose, along with a drain line, extending below the ground surface, for directing discharged water away from the drive mechanism;

FIG. 3 shows a perspective view of the movable support and an adjustable backboard in accordance with the present invention;

FIG. 7 shows a cross-sectional view of a means for mounting the fixed support to a ground surface, and a drain plate which provides a means for directing discharged water away from the ground playing surface; and FIG. 8 shows a perspective view of the drain plate shown in FIG. 7.

DETAILED DESCRIPTION

Figure 1:
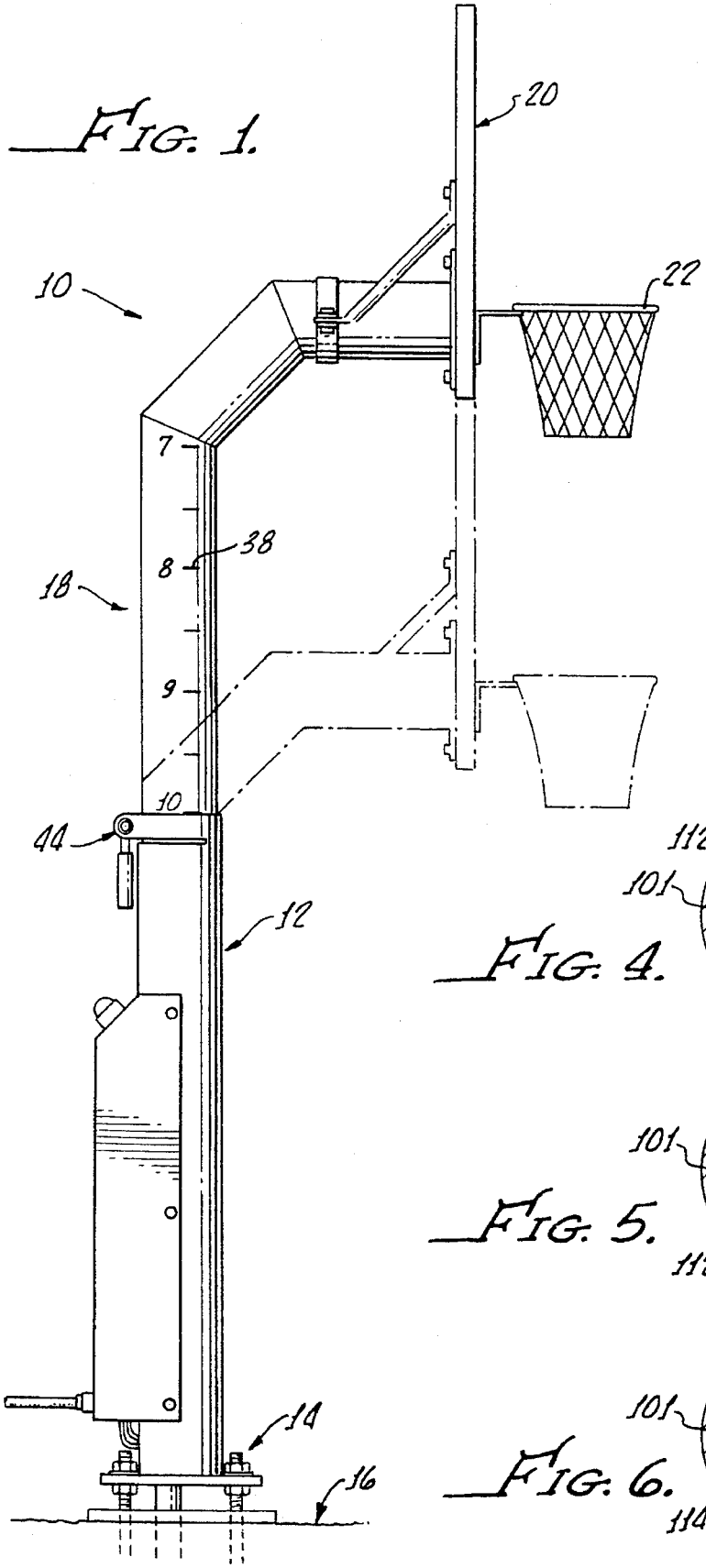
FIG. 1 shows a side view of the adjustable basketball goal, in accordance with the present invention, including a movable support telescoped within a fixed support, and a hydraulic drive mechanism powered by ordinary household water pressure.

Turning now to FIG. 1, an adjustable basketball goal 10, in accordance with the present invention, generally comprises a fixed support 12 and means, including foundation plate 14, for mounting the fixed support 12 in a substantially vertical position. Preferably, the means for mounting also includes an anchored portion 15, bolted to the foundation plate 14, which provides means for securing the fixed support 12 to a ground playing surface 16.

Telescoped within said fixed support 12 is a movable support 18, which may be forced upward or downward with respect to said fixed support 12 in order to raise or lower a basketball backboard 20 and rim 22 to a selected height above the ground surface 16.

Importantly, the basketball goal 10 includes a hydraulic, water-powered drive mechanism 30, as shown in FIG. 2. The drive mechanism 30 is comprised, in part, of a water piston 32 as well as means, such as a female hose valve 34, for providing fluid communication between said water piston 32 and a conventional garden hose 36. As will be hereinafter explained in greater detail, the drive mechanism 30 enables the utilization of standard household water pressure to raise and lower the basketball rim 22 to a selected height above the ground surface 16. Thus, as shown in FIG. 1, the basketball goal 10 may be adjusted at any selected height between, for example, a minimum setting of approximately seven feet, (shown in phantom line) for younger, smaller players, and a maximum setting of approximately ten feet or more (shown in solid line). Indicia markings 38, disposed along the movable support 18, may be provided in order to enable determination of the precise height of the rim 22 above the ground surface 16.

It should be appreciated that, with appropriate adjustments made to the hydraulic piston 32, the drive mechanism 30 may be operable by both hydraulic pressure and air pressure. In this regard, another feature of the present invention is shown in FIG. 1, particularly, a female air valve 40 as means for providing fluid communication between the piston 32 and a conventional tire pump (not shown). Thus, with the addition of this feature, the piston 32 may be driven by air pressure if so desired. In order to enable selection between hydraulic and pneumatic operation, a standard Y-valve 42, or the like, may be provided for enabling switching of the drive mechanism 30 between operation by means of the conventional garden hose 34 and operation by the conventional tire pump.

Turning again to FIG. 3, a separate clamp 44, or other suitable means, may be provided for securing the movable support 18 at a selected position with respect to the fixed support 12. Thus, once a user has adjusted the effective height of the basketball goal 10 by means of the hydraulic drive mechanism 30, as will be hereinafter explained, the clamp 44 may be set to positively latch the movable support is with respect to the fixed support 12, eliminating the need for water pressure to be maintained within the drive mechanism 30. For example, the clamp 44 may be comprised of a brace portion 46, which may be an integral part of the fixed support 12, and a cam locking lever 48. When manually forced downward to a substantially vertical position as shown, the cam locking lever 48 causes a cam surface (not shown) to tighten the brace portion 46 against the movable support 18.

Importantly, the water piston 32 is mounted in an operative relationship between the fixed support 12 and the movable support 18. As shown most clearly in FIG. 2, the water piston 32 is generally comprised of a cylinder 62 having a chamber 64 therein, said chamber 64 comprising a first compartment 66 and a second compartment 68 defined by a slidable piston head 70. A piston rod 72 extends upwardly from the slidable piston head 70 and is connected to the movable support 18 by any suitable means, such as transverse member 74 and bolts 76, as shown.

The hydraulic drive mechanism 30 enables the utilization of ordinary household water pressure to raise and lower the movable support 18. More particularly, the piston 32 is sized to be driven by water pressure between approximately 50 p.s.i. and approximately 100 p.s.i., which represents a range of typical household water pressures. The drive mechanism 30 and clamp 44 enable an infinite number of height settings between the minimum and maximum.

In operation, water pressure may be directed into either the first compartment 66 or the second compartment 68 of the piston chamber 64, by means of first piston port 86 and second piston port 88 respectively. When directed through first piston port 86, water will fill the first chamber 66, thereby forcing the slidable piston head 70 upward, which consequently drives the movable support 18 upward as well. Similarly, when water is directed into second piston port 88, the movable support 18 will be forced downward.

For proper operation of the water piston 32, means for emptying water therefrom is provided. For example, water remaining in the first compartment 66 during filling of the second compartment 68 may be forced out of the cylinder 62 through first piston port 86. Conversely, water remaining in the second compartment 68 during filling of the first compartment 66 may be forced out of the cylinder 62 through second piston port 88.

Referring now to FIGS. 2, and 4–6, preferably a valve 96 is provided which enables manual control of the hydraulic drive mechanism 30. Particularly, the valve 96 may provide means for selectively directing water pressure from the conventional garden hose 36 into either the first compartment 66 or the second compartment 68 of the water piston 32 in order to cause the movable support 18 to be raised or lowered as described above. Furthermore, the valve 96 provides means for emptying water from the piston 32 when necessary, as described above, for its proper operation. Conduit 100 may provide means for directing water from the conventional garden hose into the valve 96.

Adjusting the height of the rim 22 above the ground surface 16 is a simple, safe procedure. A user may set the height by opening a valve (not shown) connecting the household water supply to the garden hose 36. By selectively turning the valve 96, as will be hereinafter discussed in detail, the user will cause the movable support to move steadily upward or downward at a controllable pace. Adjusting the height of the rim 22 thus requires no climbing by the user to dangerous heights, or direct lifting or handling of any of the components of the goal 10. Importantly, the lowering of the movable support 18, which may be a relatively heavy component of the device, may be performed smoothly and precisely.

Figure 4:
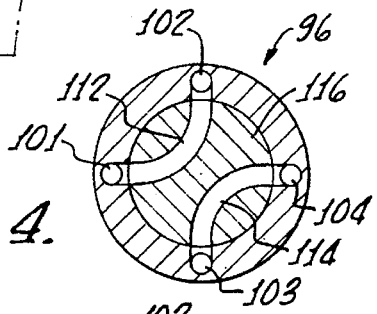
FIG. 4 shows a cross-sectional view of a valve for enabling manual control means of the drive mechanism, in which said valve has been positioned for moving the movable support upward.
Figure 5:
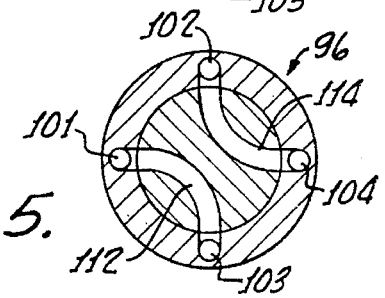
FIG. 5 shows a cross-sectional view of the valve shown in FIG. 4, in which the valve has been positioned for moving the movable support downward.
Figure 6:
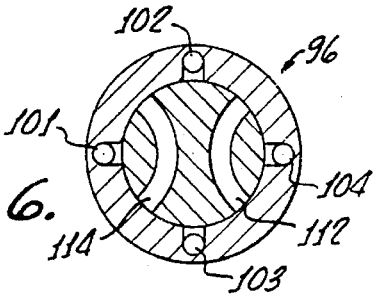
FIG. 6 shows a cross sectional view of the valve shown in FIG. 4 in which the valve is in a closed position.

FIGS. 4–6 show cross-sectional views of the valve 96 in various rotational positions. The valve 96 preferably includes inlet port 101, inlet/outlet ports 102 and 103, and outlet port 104. Note that each inlet/outlet port 102, 103 enables water flow into and out of the valve 96.

More specifically, inlet port 101 enables water to flow from the conventional garden hose 36, by means of conduit 100, into the valve. Inlet/outlet port 102 may be connected to piston first compartment 66 through a conduit 106, and inlet/outlet port 103 may be connected to piston second compartment 68 through a conduit 108. Finally, outlet port 104 may be connected to a drain conduit 110.

The valve 96 also includes a first duct 112 and a second duct 114 defined by a manually rotatable member 116. As will be discussed in detail hereinafter, the alignment of the ducts 112, 114 with the ports 101, 102, 103, 104 will determine the directional movement, upward or downward, of the movable support 18 when water pressure is directed into the valve 96.

For example, FIG. 4 may represent a cross-section of the valve 96, particularly the rotatable member 116, positioned for enabling upward motion of the movable support 18. More particularly, rotatable member 116 has been manually positioned such that first duct 112 is aligned with both inlet port 101 and inlet/outlet port 102. Thus, water pressure will be directed from the garden hose 36 into inlet port 101 and out of inlet/outlet port 102 into the first compartment, causing the piston head 70 to rise. Note that second duct 114 is positioned to enable water flow out of piston second compartment 68, into inlet/outlet port 103, and out of outlet port 104 and into drain conduit 110.

FIG. 5 shows a valve 96 cross-section after the manually rotatable member 116 has be rotated to enable the movable support 18 to travel downwardly when water pressure is forced through the valve 96. As shown, duct 112 is now aligned with both inlet port 101 and inlet/outlet port 103, thus enabling water pressure to be directed from the garden hose 36 into the piston second compartment 68. In addition, duct 114 is now aligned with both inlet/outlet port 102 and outlet port 104, thus enabling water pressure to be directed from the piston first compartment 66 out of the drain conduit 110.

Finally, FIG. 6 shows the valve 96 in a closed position, preventing both inward and outward flow of water.

Although not shown in detail, it should be appreciated that the manually rotatable member 116 may comprise a standard hand knob 120, or the like, having indicia markings, such as the words "UP", "DOWN" and "OFF" thereon for facilitating manual control of the valve 96.

Turning back now to FIG. 3, the movable support 18 may be rotatably mounted to the fixed support 12 in order to enable 360 degree rotation (represented by arrow 121) of the basketball backboard 20 and rim 22 about an axis 78 defined by the fixed support 12. This may be accomplished by a swivel connection 122 along the piston rod 72 (shown in FIG. 2), or any suitable means which will enable the movable support 18 to be manually rotated with respect to the fixed support 12. The clamp 44 described above may be used to secure the movable support 18 at the desired rotational position.

Further adjustment to the basketball goal may be made upon assembly thereof. For example, an angle of the backboard 20 with respect to the movable support 18 may be adjusted by means of sleeve 123, slidably disposed along a neck portion 124 of the movable support 18, and braces 125 connecting the sleeve 123 to the backboard 20.

Referring again to FIG. 2, drain means 126 for directing water from the piston in order to prevent accumulation of water at the ground surface 16, is shown. This safety feature is directed at preventing the playing surface 16 from becoming wet and slippery. As mentioned above, the valve 96 includes a outlet port 104 leading to drain conduit 110. The drain conduit 110 may be connected to an underground drain line 128 through the base 130 of the fixed support 12. The drain line 128 is preferably extended underground to a depth sufficient to prevent water from rising back to the ground surface 16. In addition, the drain line 128 may terminate at a bed of gravel 132, sand or other porous material, for facilitating drainage.

An alternative means for draining, comprising a drain plate 134, is shown in FIGS. 7 and 8. Thus, instead of a drain line 128 as described above, a drain plate 134 may be provided, which directs water safely to playing surface sidelines (not shown) by means of a grooved portion 136. Apertures 138 provide means for securing the drain plate 134, by bolts 140, to the ground surface 16.

It should be appreciated that the basketball goal may be a portable unit, enabling transport thereof from one playing surface to another. For example, instead of the anchored portion 15, there may be provided a wide wheeled base (not shown) enabling the entire basketball goal to the relocated if desired.

Although there has been hereinabove described an adjustable basketball goal, in accordance with the present invention, for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. An adjustable basketball goal comprising:

a fixed support;

means for mounting said fixed support in a substantially vertical position;

a movable support, telescoped within said fixed support;

means for mounting a basketball rim and backboard to said movable support;

drive means for hydraulically forcing said movable support upwardly and downwardly with respect to said fixed support in order to enable selective adjustment of a height of the rim above the ground, said height being selectively adjustable between a minimum and a maximum setting, said drive means comprising a water piston having a rod extending therefrom and mounted in an operative relationship between the fixed and movable supports, and means for providing fluid communication between the water piston and a conventional garden hose; and swivel means, disposed along the rod, for rotatably mounting the movable support within the fixed support in order to enable 360 degrees of rotation of the rim and backboard about an axis defined by the fixed support.

2. The adjustable basketball goal according to claim 1 wherein the drive means further comprises valve means for enabling manual control of said drive means.

3. The adjustable basketball goal according to claim 1 wherein the water piston includes a slidable head defining a first compartment and a second compartment, and the drive means further comprises valve means for selectively directing water pressure from the conventional garden hose to one of the first and second compartments of the water piston in order to respectively raise and lower the movable support.

4. The adjustable basketball goal according to claim 3 wherein the valve means comprises a valve having an inlet port in fluid communication with the conventional garden hose, a first inlet/outlet port in fluid connection with the first piston compartment, and a second inlet/outlet port in fluid communication with the second piston compartment.

5. The adjustable basketball goal according to claim 4 wherein the valve includes a rotatable member comprising duct means for directing water pressure from said inlet port to one of the first and the second inlet/outlet ports.

6. The adjustable basketball goal according to claim 5 further comprising drain means for directing water flow from said water piston, and for preventing accumulation of water at a ground surface.

7. The adjustable basketball goal according to claim 6 wherein the drain means comprises a drain line extending below the ground surface.

8. The adjustable basketball goal according to claim 1 further comprising clamp means for securing the movable support at a selected position with respect to said fixed support.

9. The adjustable basketball goal according to claim 1 wherein the piston is sized to be driven by water pressure between approximately 50 p.s.i. and approximately 100 p.s.i.

10. The adjustable basketball goal according to claim 1 wherein the means for mounting said fixed support includes means for securing said fixed support to a ground surface.

11. An adjustable basketball goal comprising:

a fixed support;

means for mounting said fixed support in a substantially vertical position to a ground surface;

a movable support, telescoped within said fixed support;

a backboard connected to said movable support;

a basketball rim fixed to the backboard;

means for mounting the backboard to said movable support;

drive means for hydraulically forcing said movable support upwardly and downwardly with respect to said fixed support in order to enable selective adjustment of a height of the rim above the ground, said height being selectively adjustable between a minimum and a maximum setting, said drive means comprising a water piston having a rod extending therefrom and mounted in an operative relationship between the fixed and movable supports, and means for providing fluid communication between the water piston and a conventional garden hose; and swivel means, disposed along the rod, for rotatably mounting the movable support within the fixed support in order to enable 360 degrees of rotation of the rim and backboard about an axis defined by the fixed support.

12. The adjustable basketball goal according to claim 11 wherein the drive means further comprises valve means for enabling manual control of said drive means.

13. The adjustable basketball goal according to claim 11 wherein the water piston includes a slidable head defining a first compartment and a second compartment, and the drive means further comprises valve means for selectively directing water pressure from the conventional garden hose to one of the first and second compartments of the water piston in order to respectively raise and lower the movable support.

14. The adjustable basketball goal according to claim 13 wherein the valve means comprises a valve having an inlet port in fluid communication with the conventional garden hose, a first inlet/outlet port in fluid connection with the first piston compartment, and a second inlet/outlet port in fluid communication with the second piston compartment.

15. The adjustable basketball goal according to claim 14 wherein the valve includes a rotatable member comprising duct means for directing water pressure from said inlet port to one of the first and the second inlet/outlet ports.

16. The adjustable basketball goal according to claim 11 further comprising drain means, in fluid communication with the valve, for directing water flow from said water piston and for preventing accumulation of water at the ground surface.

17. The adjustable basketball goal according to claim 16 wherein the drain means comprises a drain line extending below the ground surface.

18. The adjustable basketball goal according to claim 11 further comprising clamp means for securing the movable support at a selected position with respect to said fixed support.

19. The adjustable basketball goal according to claim 11 wherein the piston is sized to be driven by water pressure between approximately 50 p.s.i. and approximately 100 p.s.i.

20. An adjustable basketball goal comprising:

a fixed support;

a movable support, telescoped within said fixed support;

means for mounting a basketball rim and backboard to said movable support;

drive means for forcing said movable support both upwardly and downwardly with respect to said fixed support in order to enable selective adjustment of a height of the rim above the ground, said height being selectively adjustable between a minimum and a maximum setting, said drive means comprising a piston, including a rod extending therefrom and mounted in an operative relationship between the fixed and movable supports, means for providing fluid communication between the piston and a conventional garden hose, alternative means for providing fluid communication between the piston and a conventional tire pump, and means for enabling selective switching of the drive means between operation by the conventional garden hose and operation by the tire pump; and swivel means, disposed along the rod, for rotatably mounting the movable support within the fixed support in order to enable 360 degrees of rotation of the rim and backboard about an axis defined by the fixed support.

21. An adjustable basketball goal comprising:

a fixed support;

an anchored foundation plate for mounting the fixed support in a substantially vertical position to a ground surface;

a movable support, telescoped within said fixed support, said movable support including a neck portion;

a basketball rim and backboard mounted to the neck portion of the movable support;

drive means for hydraulically forcing said movable support upwardly or downwardly with respect to the fixed support in order to enable selective height adjustment of the basketball rim above the ground surface, said height being selectively adjustable between a minimum setting of approximately seven feet and a maximum setting of approximately ten feet, said drive means comprising a water piston mounted to the fixed support and including a cylinder having slidable head therein, said slidable head defining a first compartment and a second compartment of the cylinder, said water piston being sized to be driven by water pressure between approximately 50 p.s.i. and approximately 100 p.s.i., a rod, fixed on a first end thereof to the slidable head and fixed on a second end thereof to the movable support, said rod being disposed longitudinally within the fixed and movable supports, swivel means, disposed along the rod, for enabling 360 degree rotation of the movable support about the axis defined by the fixed support, in order to enable selective angular adjustment of the rim about said axis, means for providing fluid communication between the water piston and a conventional garden hose, and valve means for selectively directing water pressure from the garden hose to one of the first and the second compartments in order to respectively raise and lower the movable support, said valve means including an inlet port in fluid communication with the conventional garden hose, a first inlet/outlet port in fluid communication with the first piston compartment, a second inlet/outlet port in fluid communication with the second piston compartment, and an outlet port;

drain means for directing water from said outlet port in order to prevent accumulation of water at the ground surface, said drain means including a drain conduit in fluid communication with the outlet port, and a drain line, extending from the drain conduit through the anchored foundation plate to a gravel bed under the ground surface;

indicia means, disposed on the movable support, for enabling determination of the height of the rim above the ground surface; and means, comprising a sleeve slidably disposed along the neck portion of the movable support and braces connecting the sleeve to the backboard, for enabling angular adjustment of the backboard.

* * * * *